US005253595A

United States Patent [19]

Heidmann

[11] Patent Number: 5,253,595

[45] Date of Patent: Oct. 19, 1993

[54] MODULAR SYSTEM FOR OFFICE FURNITURE

[75] Inventor: Charles Heidmann, Strasbourg, France

[73] Assignee: Steelcase Strafor (S.A.)

[21] Appl. No.: 27,588

[22] Filed: Mar. 5, 1993

Related U.S. Application Data

[63] Continuation of Ser. No. 816,231, Jan. 3, 1992, abandoned.

[30] Foreign Application Priority Data

Mar. 19, 1991 [EP] European Pat. Off. ..... 91440021.3

[51] Int. Cl.[5] ..... A47B 3/06

[52] U.S. Cl. ..... 108/157; 108/64

[58] Field of Search ..... 108/64, 50, 157, 152, 108/153; 312/195, 150

[56] References Cited

U.S. PATENT DOCUMENTS

| | | | |
|---|---|---|---|
| 3,291,079 | 12/1966 | Ruda | 108/156 |
| 3,533,362 | 10/1970 | Thompson | 108/64 |
| 3,869,992 | 3/1975 | Kramer | 108/64 X |
| 4,300,455 | 11/1981 | Ornati | 108/156 |
| 4,772,018 | 9/1988 | Inniger | 108/64 X |
| 4,936,228 | 6/1990 | Capo-Bianco | 108/64 |
| 4,941,412 | 7/1990 | Engel | 108/157 X |
| 4,986,194 | 1/1991 | Bollman | 108/64 X |
| 5,083,512 | 1/1992 | Newhouse et al. | 108/64 X |

FOREIGN PATENT DOCUMENTS

| | | | |
|---|---|---|---|
| 2301899 | 8/1974 | Fed. Rep. of Germany | 312/195 |
| 2839770 | 3/1980 | Fed. Rep. of Germany | 108/64 |
| 679071 | 9/1952 | United Kingdom | 108/156 |
| 1321377 | 6/1973 | United Kingdom | 312/195 |

OTHER PUBLICATIONS

IBM Technical Discl. Bulletin, Feb. 1974.

*Primary Examiner*—José V. Chen

*Attorney, Agent, or Firm*—Mason, Fenwick & Lawrence

[57] ABSTRACT

A modular system for office furniture comprising a sufficient number of three types of modules, each corresponding to one or more of the following functions: a "working surface" function, a "support" function, a "storage" function, and an "electrical wire guiding function." The first module, a "table top module," provides a working surface which performs the "working surface" function. It comprises three sections, two end sections and a middle connecting section, and is supported by the second and third modules. The end sections of the first table top module each rest on a second "support" module which performs both the "support" and "storage functions." The third module is a column having upper and lower portions and performs both the "electrical wire guiding" and support functions." The upper portion contains the electrical wires of all hardware and appliances distributed on the table top module and the lower supports the middle section of the first table top module. The first table top module is held in place on the second and third modules by gravity. Two or more table top modules can be juxtaposed along two of any of their sides while resting on at least one common support module to form a variety of office furniture assemblies.

6 Claims, 2 Drawing Sheets

MODULAR SYSTEM FOR OFFICE FURNITURE

This application is a continuation of U.S. patent application Ser. No. 07/816,231, filed Jan. 3, 1992 now abandoned.

BACKGROUND OF THE INVENTION

1. Field of the Invention

This invention relates to a new modular system for office furniture, especially adapted to the creation of assemblies named "landscaped offices", made of a number of standardized elements properly assembled.

2. Related Art

Such systems are presently proposed under many presentations, having the common drawback to call for use a great number of different elements, due to the need of elements especially designed for each dimension and each place in each assembly. As an example, in very usually proposed systems, it is currently called for a number of elements, as high as five hundred, the management of which is extremely heavy and complicated. This is still more serious for companies proposing several different systems of this kind. Moreover the connection of said elements together make use of connecting elements, which can be complicated or at least need a costly manpower and is time consuming..

SUMMARY OF THE INVENTION

This invention eliminates said drawbacks, by using a new system calling in two concepts, which could be apparently considered as obvious, but which have never been taken in account.

The first of said concepts is the fact that an assembly of this nature, whatever its overall outline and dimensions, has only a limited number of functions to fulfill, i.e.:

the "working surface" function,
the support or rest function,
the storage function,
and the power conductors guiding function.

Consequently, the first basic concept of the invention is to limit the number of elements or modules in a system to those which are each necessary and sufficient to fulfill each of said functions or even simultaneously two of them.

The second concept is the fact that, using passive means for putting the modules in place, the natural gravity, i.e. the weight of a first module, is generally sufficient to connect it to a second module located beneath the first module.

Consequently, the second basic concept of the invention is to eliminate from the system any connecting element, said connection resulting only from a proper positioning and gravity.

The invention has therefore for its object a system for office furniture characterized in that it comprises the necessary and sufficient number of elements or modules, assembled and connected by gravity, each corresponding to a given function, i.e. the "working surface" function, the support/guiding function, the conducter guiding function being fulfilled by a column forming by a lower portion thereof a rest for an angle of a table top fulfilling the function of working surface, above which an upper portion of the column guides and delivers all the leads and conductors feeding all appliances distributed on said table top, said table top having, on each side of said column, a wing the end of which rests upon a box fulfilling the support function and together the storage function, the juxtaposition of at least two identical table tops along two of any of their sides with a view to extend the overall structure to assemblies of non-limited dimensions, calling for at least one common rest module, said elements being connected together by passive gravity positioning and carring means which make sure the proper connection of the respective volumes by mutual natural adaptation thereof.

DETAILED DESCRIPTION OF THE PREFERRED EMBODIMENTS

According to a preferred embodiment of the invention, the table top comprises different working portions each adapted to an "under-function", said "under-functions" being also in a limited number, which can be reduced to:

a comparatively wide portion provided to receive i.e. the informative hardware and the documents used by the operator, a comparatively medium portion, forming the desk proper, upon which the operator "works", and a comparatively narrow portion, upon which are installed phone, filing baskets, small office accessories and the same.

To this effect, the table top is dissymetrical, its two wings having different widths and being connected through an angular or round central portion resting by its external angle upon the column/connector guide, while the wings ends rest each upon a support or rest module the depth of which is egal to the width of each wing.

When a wing is "final", i.e. is at one end of the assembly, the width of the rest module can be comparatively narrow, although it can be used as a storage space.

When a wing is connected to another wing of an adjoining end of another table top, the width of the rest module should be double to accomodate the said both wing ends.

Such a "double" rest module can be the unique rest module in the system, in this case an end wing can cover the entire top of the rest module or only one half, the other half being covered by an adjacent end wing of an adjacent table top, or a shelf, or an auxiliary table or the same.

Each rest module can be properly prepared to fulfill the storage function, i.e. with drawers, doors, shelves, suspended files and the same.

The module rest column/conductor guide is a vertical prism having, at the rest modules height a cut-out part adapted to receive an angle of a table-top and, above said cut-out part an upper portion through which are guided all the leads and conductors feeding all the apparatuses and appliances distributed on said table top, all the plugs and sockets being displayed along the front face of said upper portion.

The connection of one table top with another adjoining one to create a landscaped office can be realized along any couple of sides of the same length or width, turning inside out or not, said top being usable recto-verso, with a view to create sinuous shapes of working surfaces. It can be realized using both sides of a unique column, in which case, both tops are presenting head to tail ("Tête-bêche").

A special advantage of the assemblies according to the invention is the possibility they offer to create a great number of operation stations in a comparatively small space.

As explained, the overall assembly is kept as immovable as a mono-block, due only to the weight of the tops upon the rest modules. However the tops and the rest modules can be provided with positioning means making sure the proper connection of the respective volumes through their natural mutual adaptation. Said positioning elements can be stud/cup couples or pins passing through holes in the top. The use of said means does not interfere with the gravity assembly of the elements and does not require the use of any tool.

It is well understood that other optional accessories can be added to the basic modular element above described, such as folding panels provided to close the space between two rest elements.

BRIEF DESCRIPTION OF THE DRAWINGS

The invention will now be described with reference to the attached drawings in which.

Figure 1A:
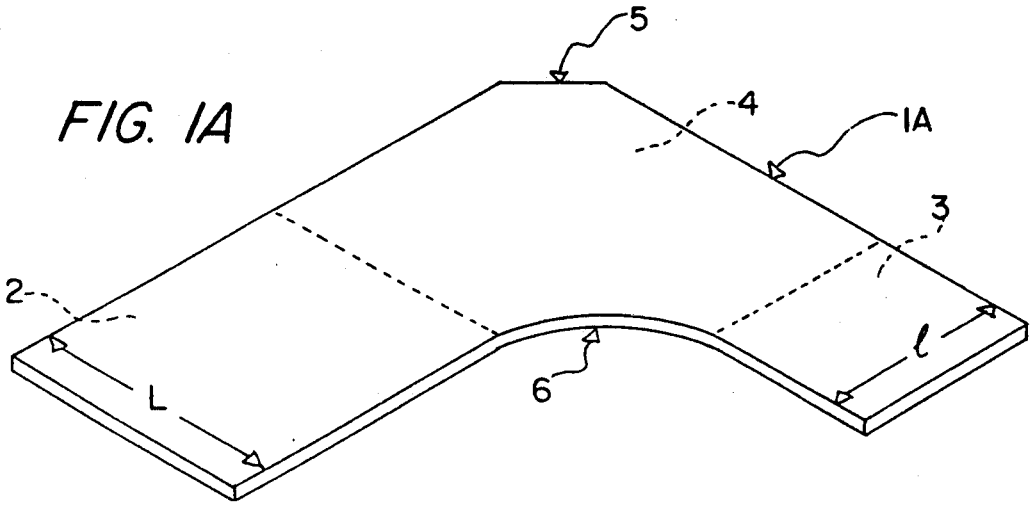
FIGS. 1A, 1B, 1C and 1D show all the elements which are needed and sufficient to build a basic assembly which can be combined with further identical assemblies to create a whole assembly having any configuration.

In this drawing, 1A is a table top provided as a working surface and comprising two rectangles 2 and 3 joined at right angle together through a third rectangle 4 having a cut off corner 5. The opposite corner 6 is cut out to accomodate the user.

In the example shown, the width L of rectangle 2 is wider than the width I of rectangle 3 but in a simpler modification, both rectangles can be of the same width.

Figure 1B:
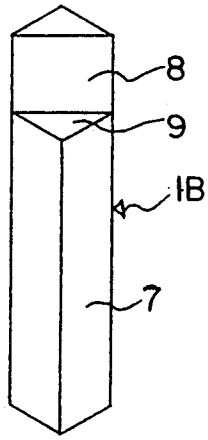
Figure 1C:
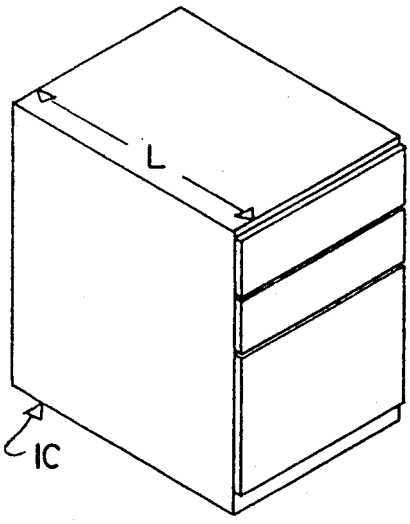
Figure 1D:
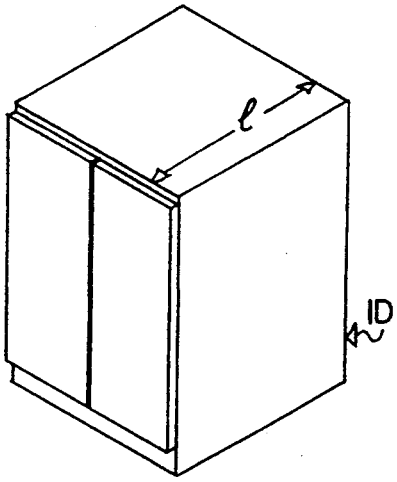

FIGS. 1C and 1D show two support elements, each having the shape of a box, the depth of which being respecting I and L corresponding to rectangles 2 and 3.

FIG. 1B shows a prismatic column 18, comprising a lower portion 7 and an upper portion 8. The lower portion 7 has a square cross section whereas the upper portion 8 has a triangular cross section, so that it remains a horizontal flat triangular surface 9 upon which the cut off corner 5 of rectangle 4 can rest.

According to a modification, the column 1B is entirely of square cross section, with a peripheral notch in place of the surface 9, said notch being slightly wider than the thickness of the plate 4, and the corner 5 is cut out to accomodate said notch.

With such a limited number of modular elements, it is possible, according to this invention, to create an unlimited number of outlines and of dimensions.

Figure 2:
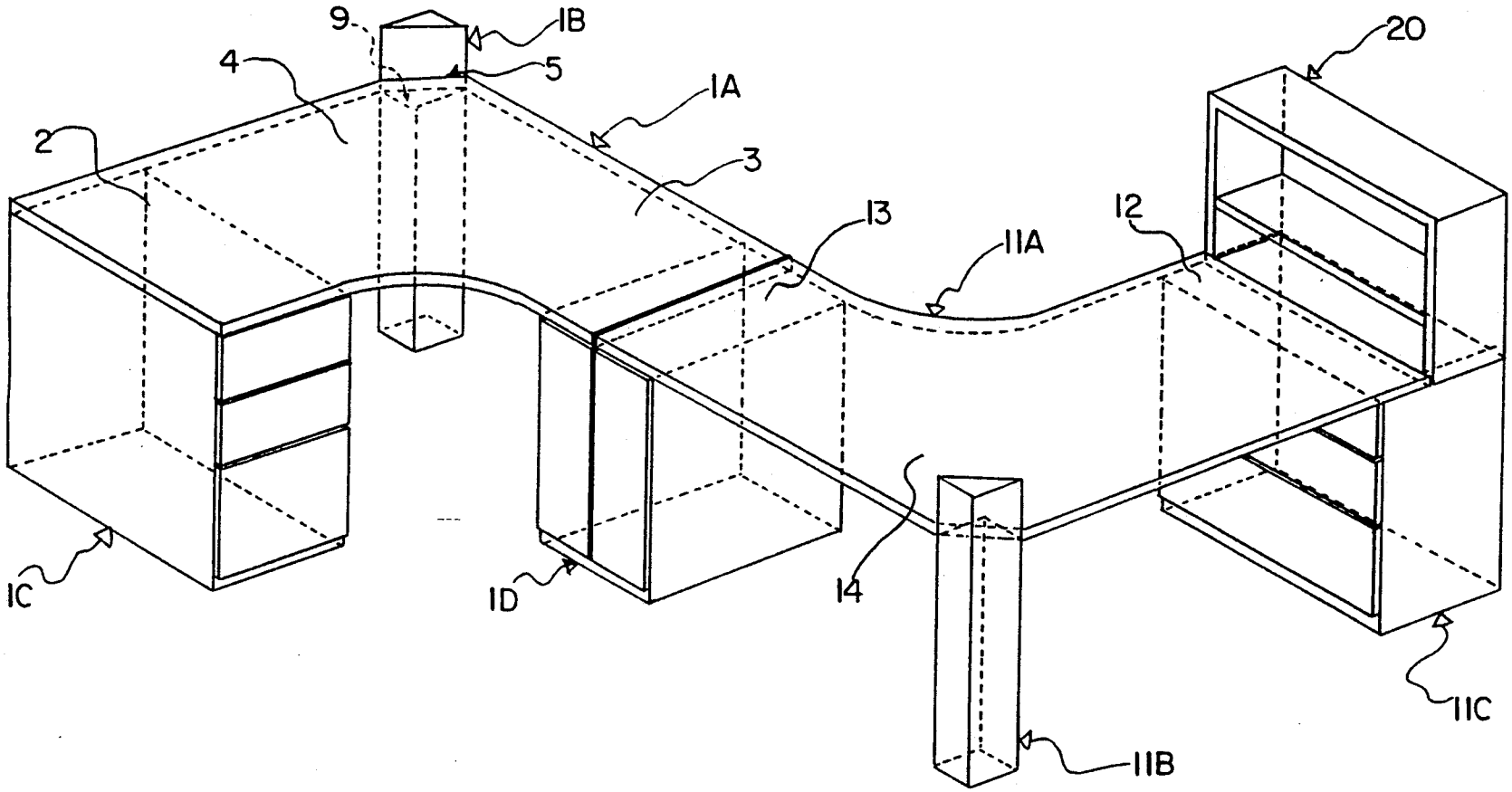
FIG. 2 shows an example of such a combination of two basic assemblies, in which it is created a sineous whole assembly.

An example is shown on FIG. 2, in which said modular elements are combined as follows:

Rectangle 2 of a first table top 1A rests upon the whole width of a support element 1C, while rectangle 3 of the same top 1A rests only upon one half of the width of a support element 1D and the cut-off corner 5 of said top 1A rests upon a triangular section of column 1B. The column 1B has plugs and sockets 25 displayed along the front face of the upper portion of the third module, which plugs and sockets are connected to leads and conductors guided through the column 1B.

A second assembly 11A-11B-11C-11D is combined with the assembly 1A-1B-1C-1D with an inverted curvature, to create an overall sinuous outline. Therefore rectangle 13 is resting upon the free half upper face of support 1D, whereas rectangle 12 rests upon half of the width of a support element 11C, the other half receiving in this example a shelf 24. A column 11B provides a support for an angle of top 11A, opposite to column 1B.

As it appears clearly, the assembly can accomodate two users who can each take three positions, i.e. before each of rectangles 2, 3, 4 (and 12, 13, 14).

In the area of rectangle 4 (and 14), the user has the widest portion of the top before him. This is the space provided for the informatic hardware and the corresponding documents.

In the area of rectangle 2 (and 12) the working area is provided for an usual office desk, while in the area of rectangle 3 (and 13) which is narrower, there can be distributed telephones, file boxes and all the usual office small materials.

To invert the curvature of tops 1A or 11A, as shown, it is only needed to turn it over.

Beyond this example it is easy to create a number of such assemblies of any dimensions and shapes. The most important feature of the invention is that said dimensions and shapes are not limited by the very small number of basic modular elements 1A-1B-1C-1D.

As already mentioned, the unsymetrical shape of the table top 1A, i.e. the different widths (L) and (l) is not a critical feature. In the case L=l, the number of basic elements is still smaller, since elements 1C and 1D are identical.

Said elements 1C and 1D can be equiped with drawers as shown in 1C, or with doors as shown in 1D or with any of the usual office accessories.

As explained above, the table tops 1A–11A just rest upon the boxes 1C-1D-11C-11D and upon the surface 9 of the column 11B where they are kept in place by their own weight. Due to this simplicity of concept and of development, the system according to the invention is exceptionnally cheap to build and to assemble. Any already existing assembly of this type can be easily modified by adding further elements or by changing the laying out of the existing elements, since no joining pieces have to be mounted and/or disconnected. This is even also true when positioning elements are additionnally provided, such as pins passing through holes in the top or stud/cup couples, since no tool is needed to clear such positioning elements.

Instead of connecting two tops along sides of rectangles 2 and 3, to obtain a continuous surface, it is possible to connect two tops along the cut off corners 5 thereof. In this case the corners of both tops should be cut out to adapt this same into two opposed notches of a column 1B.

I claim:

1. A modular system for office furniture, comprising:

a first planar module having top and bottom planar surfaces, rectangular first and second end sections having different widths, and a third angular middle section connecting said first and second end sections, said top and bottom planar surfaces defining an asymmetrical, reversible working surface, said angular middle section having a cutoff corner, and said first, second and third sections being formed as a single piece;

a second support module having a top surface configured to support the width of said first end section of said first planar module;

a third support module having a top surface configured to support the width of said second end section of said first planar module; and a fourth support module having a horizontal flat triangular surface for engaging and supporting said cutoff corner of said angular middle section of said first planar module, said fourth support module having an upper portion having a triangular cross section which extends vertically above said triangular surface and said top surface of said first planar module, said upper portion including at least one electrical outlet, and a lower portion having a square cross section extending vertically below said triangular surface and said bottom surface of said first planar module;

wherein said first, second, third and fourth modules are selectively fixed in position with respect to one another by gravity alone, said first end section of said first planar module resting on said top surface of said second support module, said angular middle section of said first planar module resting on said triangular surface of said fourth support module, and said second end section of said first planar module resting on said top surface of said third support module.

2. The modular system for office furniture of claim 1, wherein said second support module includes storage means for storing articles.

3. The modular system for office furniture of claim 1, wherein said third support module includes storage means for storing articles.

4. A modular system for office furniture, comprising:

a first planar module having top and bottom planar surfaces, rectangular first and second end sections having different widths, and a third angular middle section connecting said first and second end sections, said top and bottom planar surfaces defining an asymmetrical, reversible working surface, said angular middle section having a cutoff corner, and said first, second and third sections being formed as a single piece;

a second support module having a top surface configured to support the width of said first end section of said first planar module;

a third support module having a top surface configured to support the width of said second end section of said first planar module; and a fourth support module having a peripheral notch for engaging and supporting said cutoff corner of said angular middle section of said first planar module, said fourth support module having an upper portion which extends vertically above said peripheral notch and said top surface of said first planar module, said upper portion including at least one electrical outlet, and a lower portion extending vertically below said peripheral notch and said bottom surface of said first planar module;

wherein said first, second, third and fourth modules are selectively fixed in position with respect to one another by gravity alone, said first end section of said first planar module resting on said top surface of said second support module, said angular middle section of said first planar module resting in said peripheral notch of said fourth support module, and said second end section of said first planar module resting on said top surface of said third support module.

5. The modular system for office furniture of claim 4, wherein said second support module includes storage means for storing articles.

6. The modular system for office furniture of claim 4, wherein said third support module includes storage means for storing articles.

* * * * *